United States Patent [19]

Brown

[11] 3,930,648

[45] Jan. 6, 1976

[54] GAME RACKET AND STRINGING MEANS THEREFOR

[75] Inventor: Thomas E. Brown, Chesterfield, Mo.

[73] Assignee: A-T-O Inc., Willoughby, Ohio

[22] Filed: Sept. 26, 1974

[21] Appl. No.: 509,688

[52] U.S. Cl. ..... 273/73 D

[51] Int. Cl.[2] ..... A63B 51/00

[58] Field of Search .... 273/73 R, 73 C, 73 D, 73 F, 273/73 H

[56] References Cited

UNITED STATES PATENTS

| | | | |
|---|---|---|---|
| 1,930,285 | 10/1933 | Robinson | 273/73 C X |
| 1,937,787 | 12/1933 | Robinson | 273/73 H |
| 2,171,223 | 8/1939 | Robinson | 273/73 H |
| 3,625,512 | 12/1971 | Latham et al. | 273/73 H X |
| 3,642,283 | 2/1972 | Wilkens | 273/73 H X |
| 3,647,211 | 3/1972 | Doessel et al. | 273/73 C |
| 3,664,669 | 5/1972 | Latham et al. | 273/73 D |

FOREIGN PATENTS OR APPLICATIONS

| | | | |
|---|---|---|---|
| 2,010,450 | 3/1970 | Germany | 273/73 H |
| 237,395 | 7/1925 | United Kingdom | 273/73 D |
| 269,955 | 5/1927 | United Kingdom | 273/73 D |
| 566,130 | 12/1944 | United Kingdom | 273/73 D |

*Primary Examiner*—Richard J. Apley

*Attorney, Agent, or Firm*—Keonig, Senniger, Powers & Leavitt

[57] ABSTRACT

A game racket with a metallic frame having a head formed with an external opening groove to receive a stringer strip of suitable flexible material that is positionable within the groove of the head frame so as to protect the strings forming the playing surface of the racket from contact with the metallic frame, and stringer strip retaining tabs in position between the stringer strip and the surfaces of the groove to resist removal of the stringer strip from the groove.

2 Claims, 6 Drawing Figures

FIG. 4
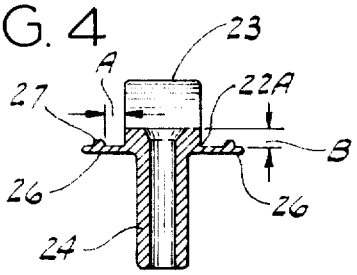
FIG. 5
FIG. 6
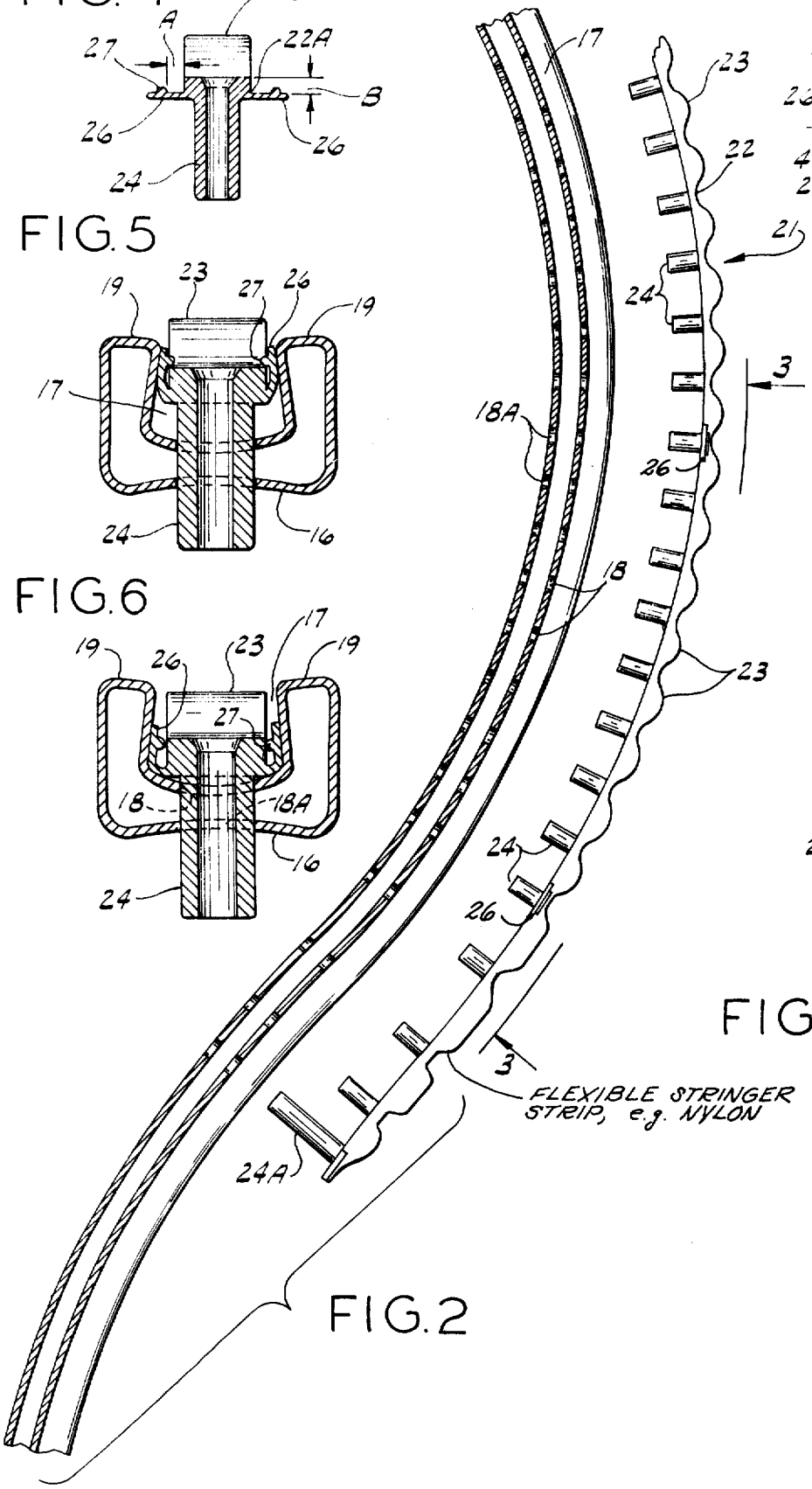
FIG. 2
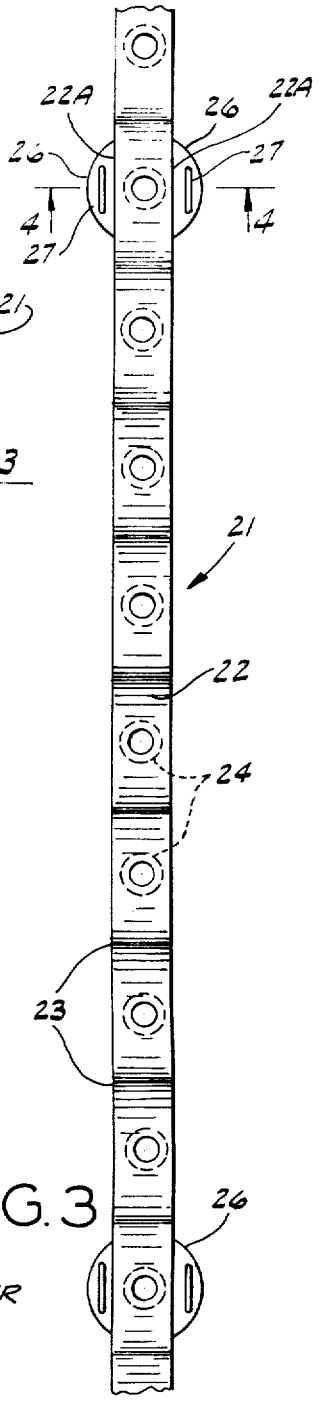
FIG. 3

GAME RACKET AND STRINGING MEANS THEREFOR

BACKGROUND OF THE INVENTION

The present invention related to game rackets having a metallic frame for supporting the strings forming the playing surfaces, and more particularly to a grooved metallic frame racket having flexible string protecting means positively held in position so as to prevent escape from the groove.

The art of manufacture of game rackets, and particularly rackets having a metallic frame has progressed to the stage where the metallic frames will successfully resist the twist and torsional stress during play, thereby making the metallic frame racket an exceedingly popular item. There is, however, a problem of preventing contact of the stringing material, which is laced back and forth across the racket frame to form the playing surface, with the metal and from working against the edges of apertures punched in the metal frame. Protection of the stringing material has been accomplished in several ways, such as by the use of metal or plastic grommets, or plastic strips positioned in an outwardly opened groove in the metallic frame when combined with intricately formed tubular guides which extend through apertures in the frame so as to space the strings away from the metallic surfaces of the apertures. In connection with the use of protective strips, it is a problem to retain the strips in the desired position in the groove of the metal frame during the stringing process, and it frequently happens that the force needed to tension the strings is sufficiently great to cause the protective strips to move out of desired position. Efforts have been made to overcome the problem of retaining the protective strips in position by securing the ends of the strips, but because of the flexibility of the material used for forming the strips the securing of the ends has proved insufficient.

An important object of the present invention is to provide a protective strip with means spaced along its length at suitable intervals to retain the strip in a groove in the frame of the game racket so that the tensioning loads imposed on the strings during the stringing process will not cause the protective strip to become dislodged from its desired position.

It is a further object of the present invention to provide the combination of a metal frame for a game racket; strings supported by said frame to protect said strings from contact with said metal frame; said metal frame having a groove opening outwardly of the frame periphery through an opening of less width than the bottom of said groove; said protective means consisting of a flexible elongated body of a width to pass through said groove opening in either direction, tabs spaced along said flexible body to project laterally therefrom into positions crosswise of said groove, said tabs being foldable along side said elongated body to allow said body to pass into said groove, and string guides spaced at intervals along said body and projecting through the bottom of said groove.

It is an additional object of this invention to provide a stringer strip for a game racket having a metallic head frame formed with a dovetail groove around its outer perimeter and stringing apertures spaced at intervals through the bottom of the dovetail groove; said stringer strip comprising an elongated body with string supporting pads spaced along one side and string guides fitting the head frame stringing apertures to protect the strings from engaging on the metallic head frame and said pads supporting the strings in the dovetail groove between said guides, and means cooperating with said stringer strip and the dovetail groove to hold said stringer strip within the dovetail groove, said holding means having projections at spaced intervals along the length of said stringer strip, said projections being foldable in one direction to permit entry of said stringer strip into the dovetail groove and to block the escape of said stringer strip.

An additional object of this invention is to provide a game racket providing a metallic frame formed from tubular stock shaped into a head having a dovetail groove in its outer margin and a plurality of apertures in the bottom of the groove and spaced at intervals along the groove, a stringer strip having an elongated body with tubular string guides spaced at intervals therealong to match said apertures in the bottom of said dovetail groove, strings laced through said string guides and across the circular head area to form a playing surface, and retainer means cooperating with said stringer strip and said dovetail groove to maintain said stringer strip in said groove, said retainer means being spaced along the length of said stringer strip between the ends thereof.

Still another object of this invention is to provide retainer means for game racket stringer strips in which the retainer means is integral with and foldable against the sides of stringer strip so as to be able to enter the opening in a dovetail groove and thereafter unfold within the dovetail groove to a position capable of resisting removal of the stringer strip.

Other objects and the advantages for this invention will appear in the detailed description of a preferred embodiment.

BRIEF DESCRIPTION OF THE DRAWINGS

A preferred embodiment of the present invention is shown in the accompanying drawings wherein:

FIG. 2 is a fragmentary portion in exploded sectional view of a metallic frame and a stringer strip showing the general characteristics of the embodiment of this invention;

FIG. 3 is a fragmentary and an enlarged plan view of a portion of the stringer strip as seen along lines 3—3 in FIG. 2;

FIG. 4 is a greatly enlarged sectional view through the stringer strip shown at lines 4—4 in FIG. 3;

FIG. 5 is a greatly enlarged and fragmentary sectional view showing the stringer strip during its entry into the dovetail groove in the metallic frame; and FIG. 6 is a view similar to FIG. 5 but showing the stringer strip in its assembled position.

DETAILED DESCRIPTION OF THE EMBODIMENTS

Figure 1:
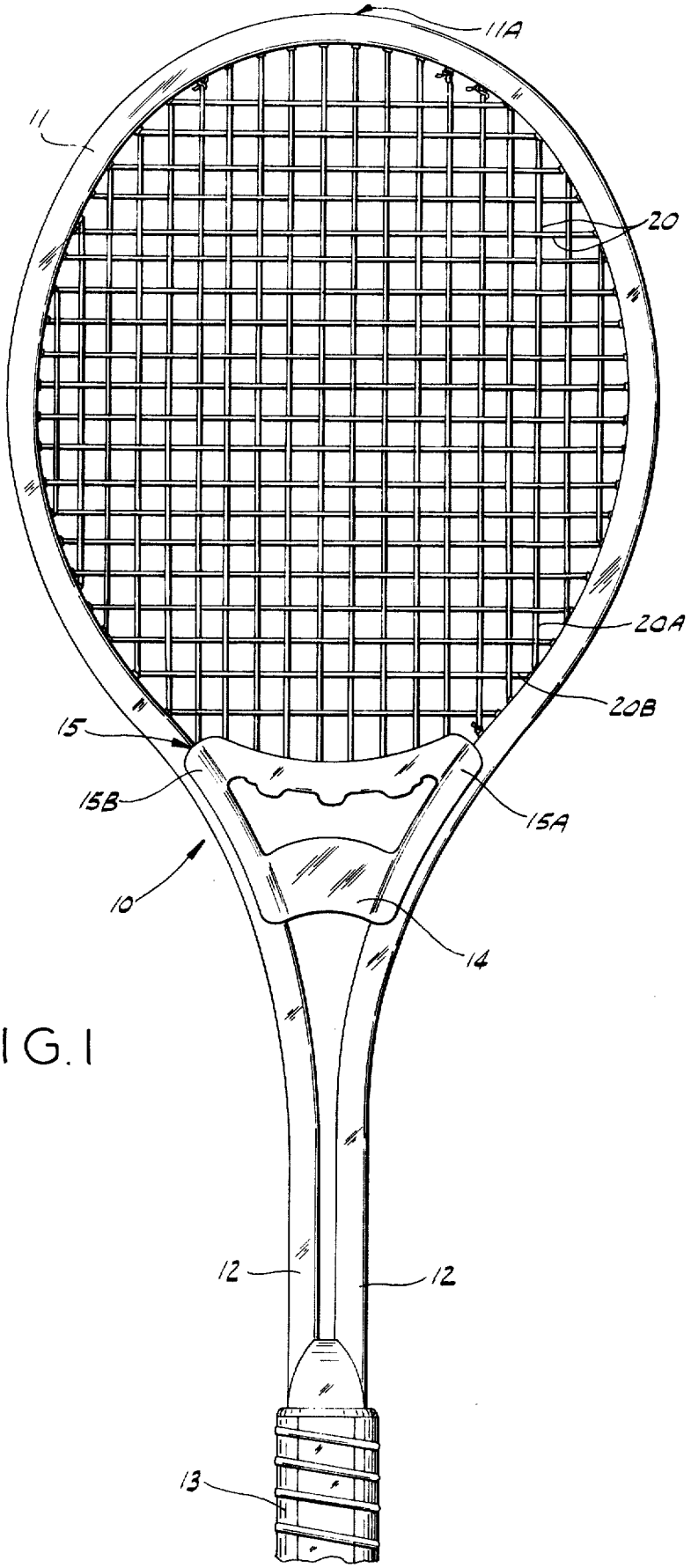
FIG. 1 is a fragmentary plan view of a metallic game racket showing the head frame with the strings in place to form the playing surface for the racket.

Referring now to FIG. 1 the game racket of the preferred embodiment takes the form of a metallic tennis racket 10 having a one-piece drawn and tempered aluminum frame in which the head frame 11 is integral with the handle 12. The handle 12 is constituted by continuing the wrap of the head frame into handle 12. The handle is provided with a grip 13 which is suitably secured in position. Between the handle and the head of the racket there is provided a yoke 14 secured in desired manner to the frame 11 so as to provide a curved closure member 15 to complete the outline for the playing area of the racket head.

FIGS. 2 and 6 taken together show the form of the drawn and tempered aluminum portion of the frame. In this embodiment the frame is formed of a tubular member having an inner wall 16 and an opposite and outwardly opening dovetail groove 17 which extends around the periphery of the frame 11 and handles 12. The opening to the groove 17 is of less width than the bottom of the groove so as to conform to a standard dovetail configuration. The bottom of the groove 17 and the opposed wall 16 are perforated at suitable intervals around the head frame at aligned apertures 18 and 18A. Thus, the frame takes the form of a dovetailed groove 17 flanked by stiffening beads 19 on each side.

The means for preventing contact of the strings 20 with the metallic frame is a flexible and non-metallic stringer strip 21 best seen in FIGS. 2 and 3 (molded of a plastic such as nylon). The stringer strip has a body 22 formed on its outwardly presented surface with a series of spaced pads 23 that support the return bend of the strings 20. The opposite surface of the body 22 of the stringer strip 21 is provided with projecting tubular string guides 24 which are spaced at the same intervals as the aligned apertures 18 and 18A in the metallic frame. The stringer strip 21 is formed in two parts so that each strip extends from approximately the tip 15A of the yoke 15 at one side to the outer edge 11A of the head frame 11, and from the opposite tip 15B around to the outer edge 11A of the head frame 11. The tubular guides 24 are inserted in the respective apertures 18 and 18A, except that the starting tubular guides 24A is longer than the other guides so as to reach through the tip portions 15A or 15B of the yoke 15.

The means to retain the stringer strip in the dovetailed groove 17 can be seen in FIGS. 3 and 4, and takes the form of part-circular tabs 26 projecting outwardly from the opposite sides of the stringer strip body 22 so as to support on its upper surface projections or lugs 27 that are elongated in the lengthwise direction of the stringer strip 21 and are spaced outwardly from the sides 22A of the stringer strip body a distance A slightly less than the heighth B of the body sides 22A above the surface of the tabs 26. The tabs 26 are sufficiently thin to be flexible and therefore foldable upwardly toward the sides 22A, but because of the presence of the lugs 27 engaging the sides 22A the resulting overall width of the stringer strip at the location of the tabs 26 is greater than the opening to the dovetail groove 17.

Referring now to FIGS. 5 and 6, there is shown in FIG. 5 the folded condition of the tabs 26 during the entrance of the stringer strip body 22 into the dovetail groove. During this assembly the tabs 26 are caused to wipe against the surfaces at the entrance to the dovetail groove and the friction engagement causes the tabs to stretch sufficiently so that the rounded surface of the lugs 27 cause the lugs to ride up on top of the body 22, thereby allowing the width dimensions of the stringer strip to conform to the width at the entrance to the dovetail groove 17. In FIG. 6 the stringer strip has been completely inserted into the dovetail groove and the tabs 26 find sufficient room to unfold to a partial extent such that they are in contact with the side walls of the groove at the wide portion below the entrance to the groove. Now, if a force is applied on the stringer strip to remove it from the dovetail groove the tabs 26 will be jammed inwardly toward the sides 22A of the stringer strip body and the lugs 27 cannot pass over the top of the body 22 but are forced against the sides 22A, thereby enlarging the width dimension of the stringer strip to one that is greater than the width dimension at the entrance to the dovetail groove. The result is that the stringer strip is retained in its intended protective position in the dovetail groove. A sufficient number of pairs of tabs 26 can be formed on the stringer strip at suitable spacing intervals to hold the stringer strip in the desired position.

Referring again to FIG. 1 it can be appreciated that there are a number of places around the head frame 11 where the main longitudinal strings running parallel to the lengthwise axis of the racket enter the same apertures as the cross strings. During the stringing process the main longitudinal strings are first placed in position and brought up to desired tension. The cross strings are then interwoven with the main strings and tension is also applied. In the course of this process, certain guides may receive tension loads tending to make the stringer strip move out of the groove. For example, in tensioning string 20A by pulling on it in downward direction as viewed in FIG. 1 (before string 20B is applied), the tension tends to move the strip out of the groove at the lower right-hand portion of the head. This tendency to move the strip out of the groove occurs particularly at the regions where the strings pass through the frame at an angle, and each stringer strip guide 24 becomes an obstruction to the tendency of the respective string to follow the straight-line shortest-distance path from point to point across the frame. However, the present means for retaining the stringer strip in the dovetail groove assures the positioning of the stringer strip against the tensioning loads applied to the strings. The retaining means in the form of the tabs 26 are distributed in pairs along the sides of the head frame 11 at suitable places between the yoke 15 and the outer edge 11A of the head frame 11.

The present invention provides a simple and easily installed protective stringer strip for game rackets which have main and cross strings forming the playing surface, and the means for retaining the stringer strips in operative position is both simple in construction and positive in performance, and adds greatly to the effective stringing of game rackets so as to prevent the strings from engaging on the metallic frame or being cut by the sharp edges of the perforations formed in the frame.

What is claimed is:

1. A racket comprising a metal frame head, said head having an external peripheral dove tail shaped groove and holes for passage of strings extending from the base of the groove to the inside of the head, the groove having a relatively narrow entrance at the outside of the head tapering to a relatively wider section inward of the entrance adjacent said base, said groove having imperforate side walls, and a stringer strip received in the groove, said strip having a body which, throughout the length of the strip, is narrower than said entrance of the groove for being inserted in the groove through said entrance without any substantial lateral compression of said body, said strip having tubular string guides projecting from the inside surface of the body thereof and extending through the holes in the head, said strip further having a plurality of tabs spaced at intervals along its length projecting laterally outwardly from opposite sides of said body adjacent the inside surface of said body, said tabs being thin relative to the height of said body and flexible so as to be foldable upwardly on the sides of said body upon insertion of said strip in said groove through said entrance, each of said tabs having thickened projections formed on the outside upper surfaces of said tabs, said projections being elongated in the lengthwise direction of said strip and being spaced laterally from the sides of said body slightly less than the height of said body sides above the upper surfaces of said tabs, said projections being so formed that when the tabs are folded upwardly said projections will overlie said top of the strip thereby allowing the width dimensions of said strip to conform to said entrance width of said groove, and upon complete insertion of said strip in said groove said projections will abut the sides of said body and a substantial portion of said side walls of said groove below the entrance of said groove to establish a width dimension greater than said entrance width to retain said strip in said groove.

2. A racket as set forth in claim 1 wherein the upper surface of said strip is formed with a series of undulating arcuate pads for engagement by the strings between adjacent pairs of said tubular guides, said tabs being located at regions between pads so that said thickened portions of the tabs overlie the top of the strip between pads.

* * * * *